US005125768A

United States Patent [19]

Ilomäki

[11] Patent Number: 5,125,768

[45] Date of Patent: Jun. 30, 1992

[54] METHOD AND APPARATUS FOR THE PRODUCTION OF UNDERGROUND PIPELINES

[76] Inventor: Valto Ilomäki, Loilantie 8, SF-33470 Ylöjärvi, Finland

[21] Appl. No.: 598,731

[22] PCT Filed: Apr. 11, 1989

[86] PCT No.: PCT/FI89/00067

§ 371 Date: Oct. 19, 1980

§ 102(e) Date: Oct. 19, 1980

[87] PCT Pub. No.: WO89/10467

PCT Pub. Date: Nov. 2, 1989

[30] Foreign Application Priority Data

Apr. 27, 1988 [FI] Finland ..... 881964

[51] Int. Cl.[5] ..... E21D 1/06

[52] U.S. Cl. ..... 405/150.1; 405/138; 405/141; 405/184; 299/18; 299/56

[58] Field of Search ..... 299/56, 57, 64, 67, 299/18; 405/138, 140, 141, 142, 150.1, 184, 155

[56] References Cited

U.S. PATENT DOCUMENTS

| | | | |
|---|---|---|---|
| 2,821,374 | 1/1958 | Gardner | 299/56 |
| 2,919,121 | 12/1959 | Ruth | 405/138 X |
| 2,946,567 | 7/1960 | Pepper | 299/67 X |
| 3,663,054 | 5/1972 | Dubois | 299/18 |
| 4,229,042 | 10/1980 | Plummer | 299/18 |
| 4,506,931 | 3/1985 | Haspert | 299/56 X |

FOREIGN PATENT DOCUMENTS

| | | | |
|---|---|---|---|
| 649983 | 11/1964 | Belgium | 299/56 |
| 3000683 | 7/1981 | Fed. Rep. of Germany | 405/138 |
| 3228684 | 2/1984 | Fed. Rep. of Germany . | |
| 3306047 | 8/1984 | Fed. Rep. of Germany . | |
| 51726 | 7/1972 | Finland . | |
| 278698 | 11/1989 | Japan | 405/138 |
| 2106161 | 4/1983 | United Kingdom | 405/141 |

*Primary Examiner*—Randolph A. Reese
*Assistant Examiner*—John A. Ricci
*Attorney, Agent, or Firm*—Larson and Taylor

[57] ABSTRACT

A method and apparatus for producing an underground pipeline from an excavated hole uses a drill head with a suitable tool attached thereto. Loosened soil is transported out of the drilled tunnel with a transportation drum containing an internal spiral. The drum is supported by a roll devices fixed to outer pipes. Rotating movement is transmitted to the rotating drill head from the transportation drum which is driven by a motor. Cylinders push the whole system and force is transmitted by the outer pipes to the drill head. Guiding of the drill head is accomplished with fluid actuators. Attachment and removal of the drill tool is accomplished through a free hole in the transportation drum and a central hole in the drill head, and the free hole and central hole also allow observation of the drill tool and tunnel face during drilling.

13 Claims, 5 Drawing Sheets

METHOD AND APPARATUS FOR THE PRODUCTION OF UNDERGROUND PIPELINES

FIELD OF THE INVENTION

This invention relates to a method and to an apparatus for the production of tunnels for underground pipelines without moving soil above the pipeline. Soil or rocks means to be removed are loosened by some known method. Loosened material is removed from the tunnel by a rotating transportation drum rotating on rolls inside the pipe meant to be assembled into the ground.

BACKGROUND OF THE INVENTION

Building of underground pipelines can be done according to several different principals. The most simple way is to dig ground away in the place where the pipeline is planned to be and to lay down pipes in the excavation and refill the excavation. However this can not always be done with open excavation, for instance because of roads or lakes. In these cases one must use some kind of underground method.

In case of small diameter pipes and short distances, soil displacing methods can be used in which the pipe is pressed in the desired direction by a force strong enough to move the pipe. In the end of the pipe there is placed a formed point which displaces the soil as much as the pipe requires. An apparatus based on such displacement of soil is presented in patent document FI-51726. While it is relatively easy to make small holes by this method, in case of larger diameter holes, friction against displacement becomes so strong that energy sources available to be used in this purpose, can not produce the force needed, or use of them is uneconomical. Because of this, in case of larger diameter holes, one has to use mechanical hammers or cutters.

In production of larger diameter holes, loosened soil must be removed from the hole. For instance in patent document FI-51726 there is shown a method to remove broken soil from the hole through the pipe by pressurized air.

In other earlier known method for removal of loosened soil is for instance a transportation screw assembled in the pipe following the drill head, as is shown for instance in German patent document DE 33 06 047. In the system described in this document, a drill head is assembled in the supporting pipe which contains a transportation screw. The diameter of this screw is such that its outer diameter is nearly equal to inner diameter of supporting pipe. In this construction, the transportation screw is moving in relation to supporting pipe.

In German patent document DE 32 28 684 there is shown a construction in which the transportation screw is located in the supporting pipe whose diameter is essentially smaller than diameter of the pipe to be assembled. In this case, location or direction determination of drill head can be executed through an upper area of the pipe, which is remaining free.

As defects of present methods one can mention that visual observation of drill head is limited. Also, reparation requires a drawing out of the drill head, which operation in many cases is difficult and takes a long time.

Also as a defect can be mentioned that the construction of the transportation screw limits the diameter of rocks able to be transported through the screw. Also, emptying of a clogged transportation screw is difficult, because construction of the screw is closed.

SUMMARY OF THE INVENTION

With the apparatus and method according this invention one can make a remarkable improvement in said defects. Characteristics of the apparatus and method according this invention are presented hereinafter.

As the most significant benefit of this invention one can mention that the drill head can easily be observed and there is a spacious and small fractioned way to transport the loosened soil. Also, because of the large diameter transportation pipe, it is possible to transmit a large torsional moment to the drill head. While the free center of the transportation pipe is large, one can also transport through the drum for instance tools, etc. This is good when, after drilling with only the drill head in soft soil, one meets rock. Then one has to transport a hammering tool to drill head and assemble it. Also whole rocks with diameters almost the same as the drum can be transported through the transportation drum. While drilling it is possible to observe the end of the tunnel and the quality of the ground can be seen and examined through the pipe. Further, tools can be reassembled and removed the same way, and in some cases that free hold is large enough for man to go through.

BRIEF DESCRIPTION OF THE DRAWINGS

In the following, the invention will be examined more closely referring to drawings enclosed.

DETAILED DESCRIPTION OF THE PREFERRED EMBODIMENTS

Figure 1:
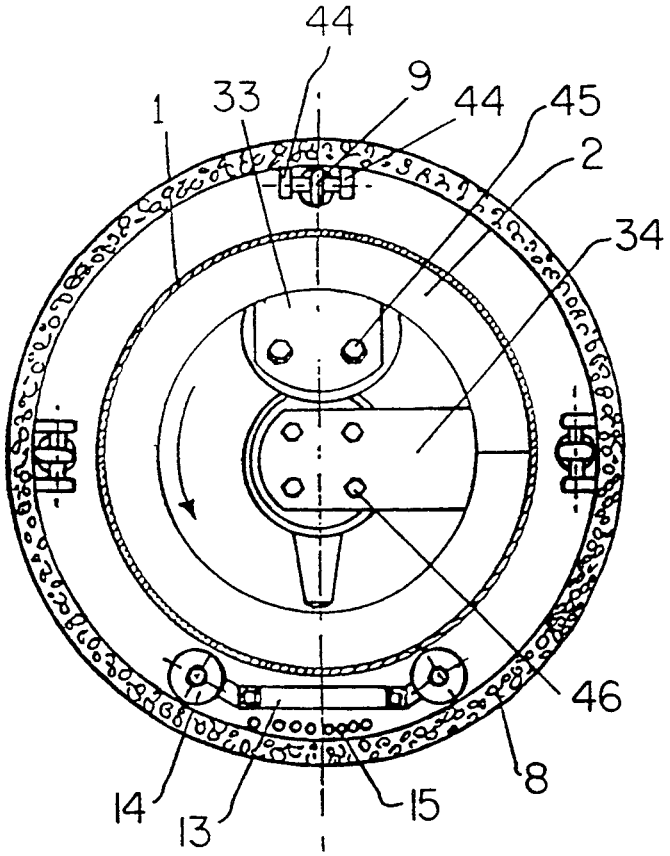
FIG. 1 shows a radial section along the line 1—1 in FIG. 2 of a transportation drum and protective pipe.

In FIG. 1 is shown schematically transportation drum (1) which is rotating on rolls (14) of supporting roll device (13), which roll devices are fixed in assembled pipe (8). Hydraulic cylinders (9) guiding a drill head get their pressure through hoses (15), which are led through a lower part of piper (8). Roll device (13) can be fixed in pipe (8).

Figure 2:
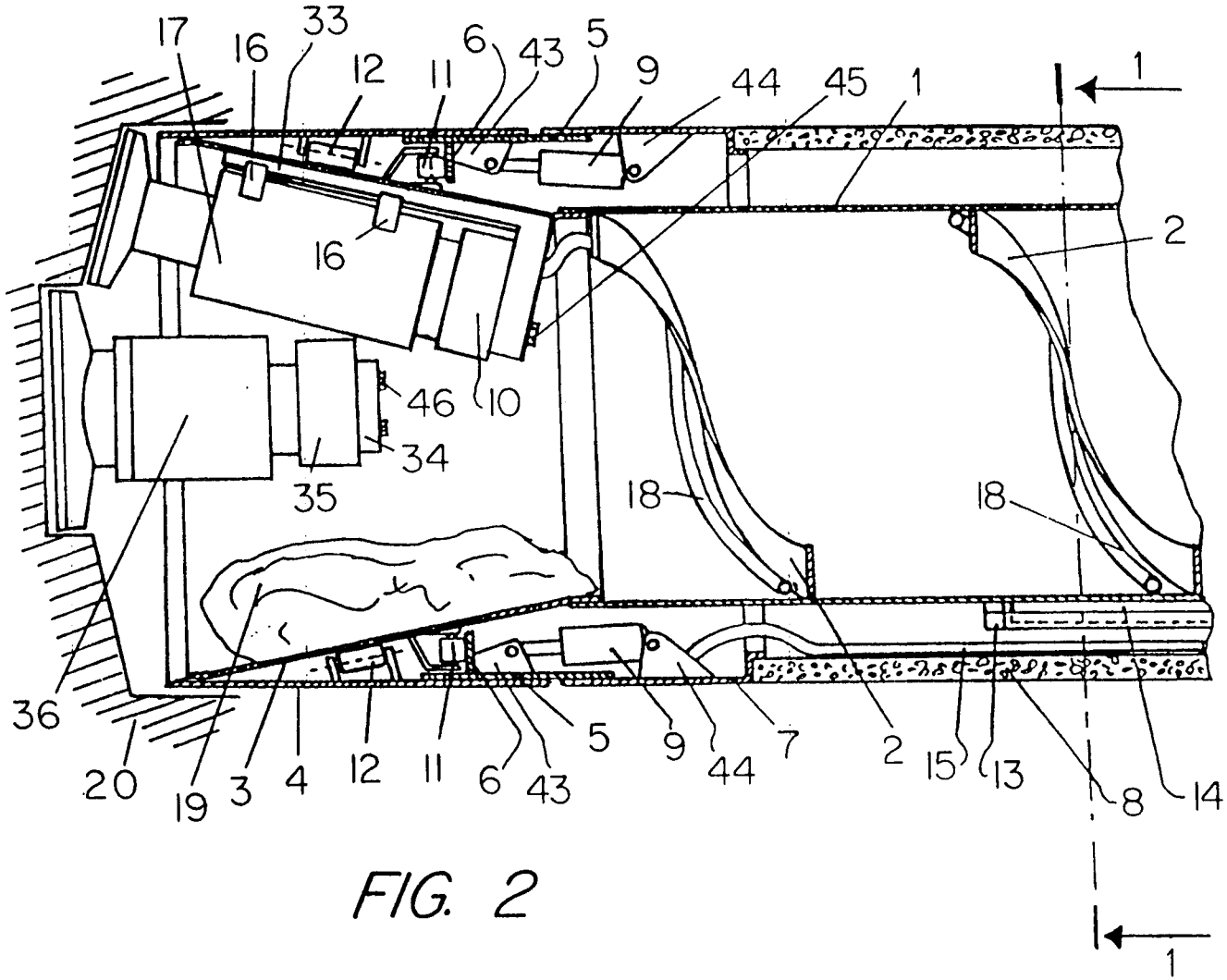
FIG. 2 shows a longitudinal section of the drill head and transportation drum.

In FIG. 2 is shown the head of the device which is going into the ground. Soil or rock hammering tools (17, 36) are fixed in rotating conical part (3) with fixtures (33) (34) and screws (45,46). These hammering tools can slide in parts (16), in case one wants to move these tools in with cylinders (10) or (35). Thus, the hammering tools can move against force caused by pressurized material in cylinders (10,35). Entering into rock is most suitably done when one tool (36) is drilling a large diameter hole in the center of the tunnel and another tool (17) is drilling a circle in an outer part of the hole. Supporting rolls (11) give axial support. Rolls (11) are supported by flange (6), which can be adjusted to a desired direction in relation to cylindrical part (7) by hydraulic cylinder (9). The cylinders (9) have been jointed with parts (43,44). Adjustment of the direction penetration is done with cylinder (9) by turning flange (6) to a desired direction. Supporting rolls (12) are fixed in cylinder part (4), which rolls are turning in relation to cylinder part (7) while the head part is turned. Flange (6) is fastened to cylinder part (5), which can slide and when needed turn in relation to cylinder part (7). Hydraulic cylinders (9) are fastened at one end to cylinder part (7) and at the other end to guiding cylinder part (5) and to flange (6). Rotating movement of head (3) is caused by inner pipe (1) which is jointed to head (3) in case of small internal differences in direction. Inner pipe (1) has internal spiral (2), which is transporting from the ground loosened material (19) to the back of the device. Energy that each hammering tool (17,36) needs is delivered through pneumatic hose (18), which is located in on a back side of spiral (2) where it is protected against abrasive effect of the soil. Pneumatic air is also led to cylinders (10) and (35), which are moving tools (17),(36). Outer pipe (8) is most usually concrete and it is left in the tunnel. Motion and force needed by head (3) is transmitted with outer pipe l(8). These motions and forces variate according to the quality of the ground.

Figure 3:
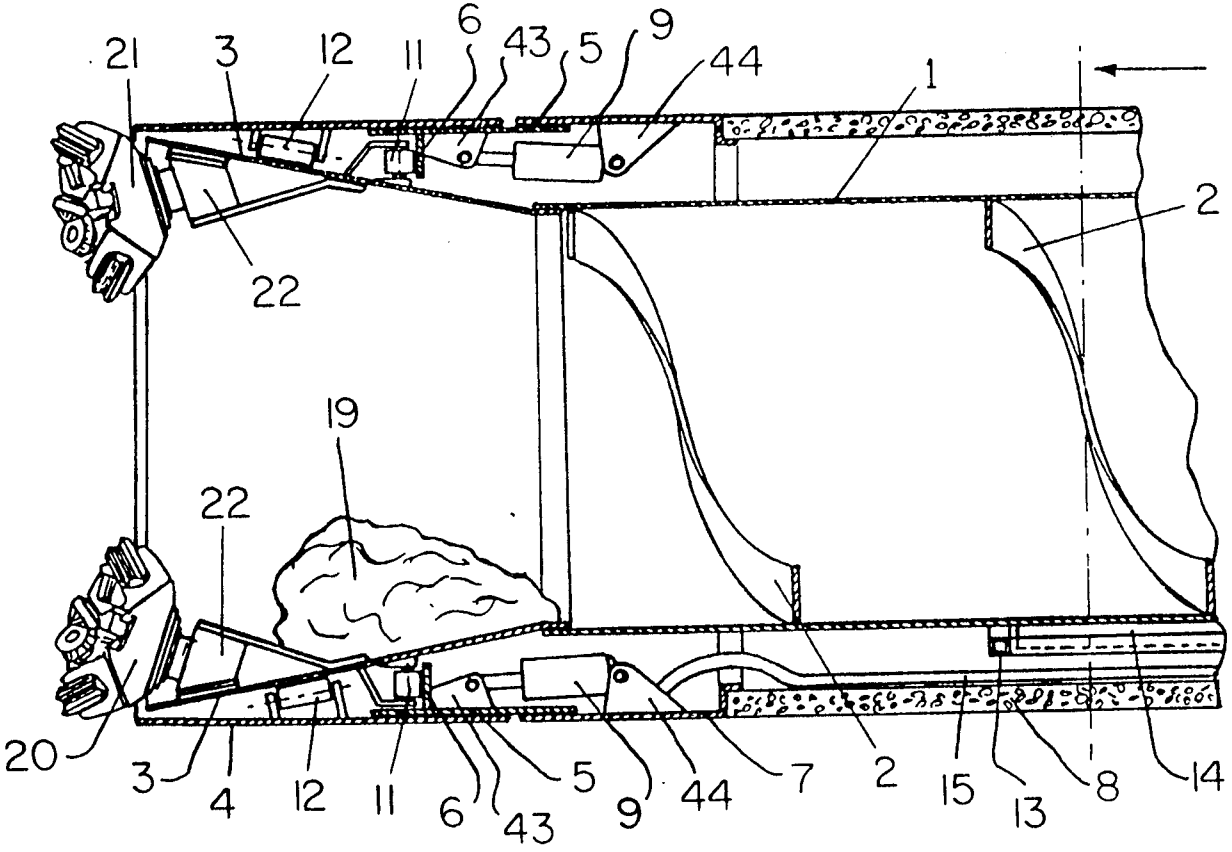
FIG. 3 shows a drill head with a rotating cutting head.

In FIG. 3, is shown head (3) of the device penetrating into the ground. Rotating cutters (20) and (21) are jointed in heads rotating conical part (3) with bearings, and these cutters rotate around a shaft of the their own because of rotating movement of conical part (3) and because of their own angular position.

Figure 4:
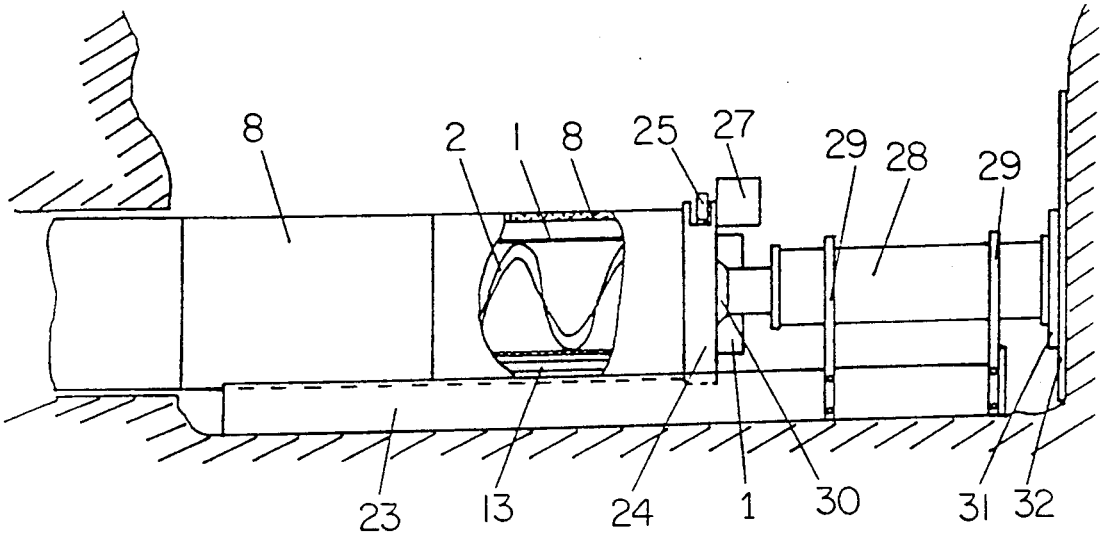
FIG. 4 shows a side view of the device located in a starting hole.
Figure 5:
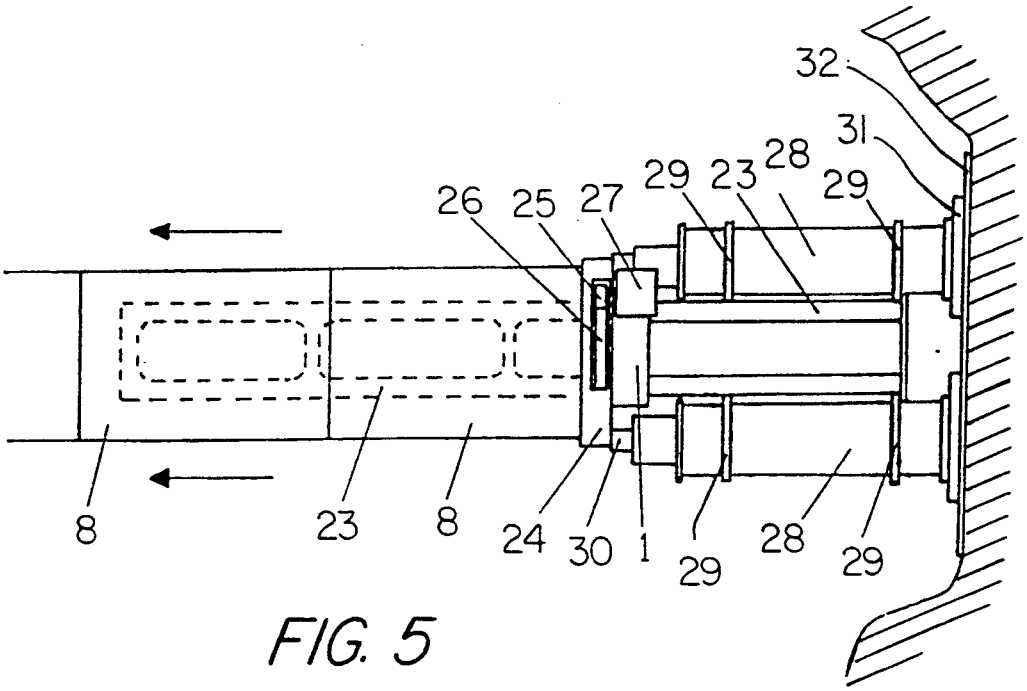
FIG. 5 shows a top view of the device located in the starting hole.

In FIGS. 4 and 5 is shown a back part of a starting hole. In the hole there is frame construction (23) over which new outer pipe (8) parts and inner pipe (1) parts are lifted while head (3) of the device is entering and push cylinders (28) have pushed earlier pipe parts into the hole. Push cylinders are supported with plates (31) and (32) to back wall of the starting hole. Cylinders (28) are to the frame construction with parts (29) that cylinders (28) are able to slide on parts (29) backwards, in case soil in the back wall of the starting hole is moving because of push the force. Thus, frame construction (23) can stay in its original position and thus is desirable because the exact starting direction of the tunnel has been adjusted with frame construction (23). Cylinders (28) are pushing outer pipe (8) with special flange (24) with the help of adapters (30). In the flange (24) there is rotatable cogged part (26), which is rotated with motor (27) and cogwheel (25). Rotating cogged part (26) is quick-jointed with some known method to that the adjacent inner pipe l(1), which is in turn to be pushed. Every inner pipe is tied to the next one by the known quick-joint method, for instance with chain, so that rotating movement is transmitted to head part (3). Transporting spiral (2) transports loosened soil to starting hole, from which the soil can be ejected. During the whole working period, the filling rate of the spiral is low so that continuous drill head observation is possible.

Figure 6:
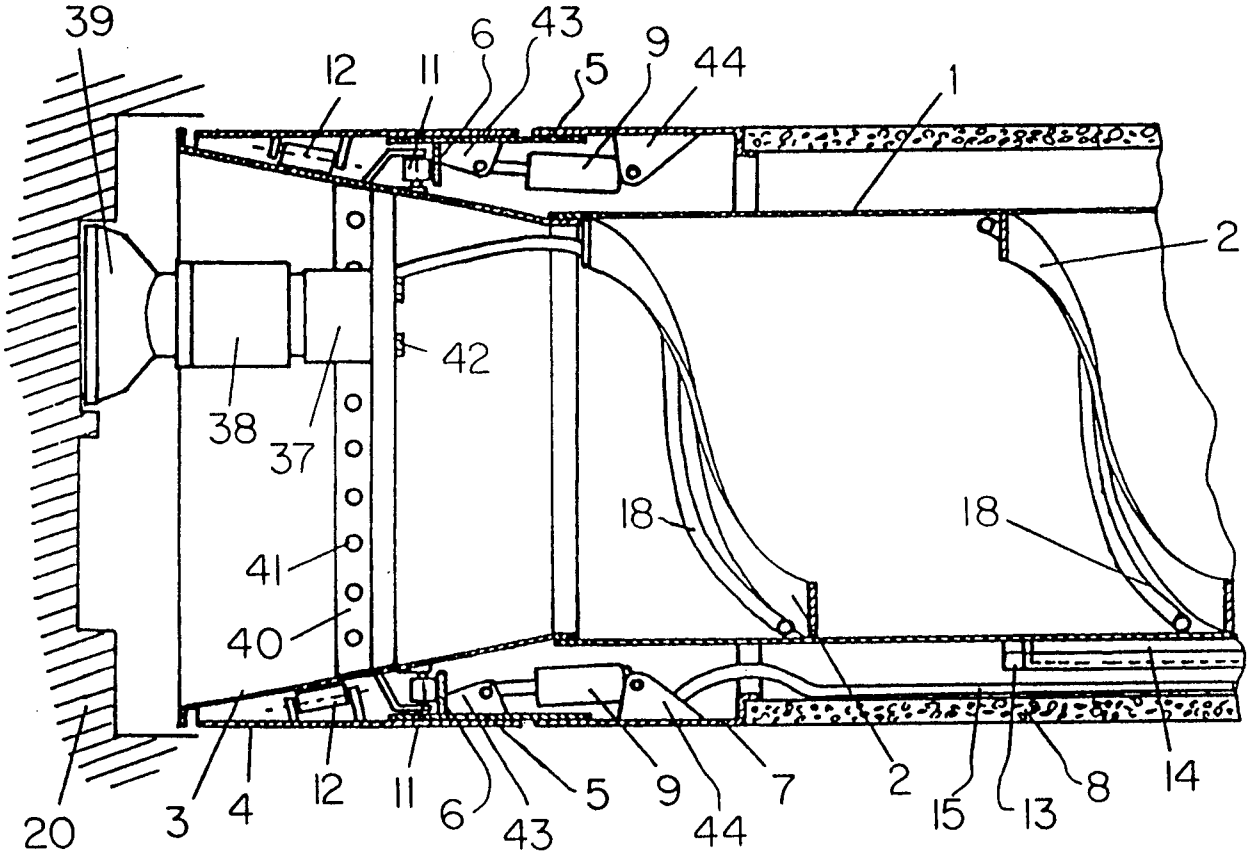
FIG. 6 shows an alternative way to fix the cutter.

In FIG. 6 is shown cutting tool (38) which is fastened in drill head (3). Cutting tool (38) contains cutting head (39) and cylinder (37) able to push to one direction and retreat to an other direction. Tool (38) is fastened with screws (42) in holes (41) in crosswise bar (40) jointed to drill head (3). Tool (38) can cut especially in rock different diameter ring shape cuttings. It is possible to have several tools jointed in bar (40). It can also be possible to choose the diameter to be cut as the position of tool (38) in bar (40) can be adjusted by moving tools in bar (40) for instance with hydraulic or pneumatic pressure.

While only one embodiment of the present invention has been described in detail herein, various modifications and changes may be made without departing from the scope of the invention.

I claim:

1. A method for producing an underground pipeline from an excavated hole comprising the steps of:

assembling in the excavated hole a longitudinal pipeline of outer pipes by successively adding a new outer pipe in the excavated hole to a preceding outer pipe to form the pipeline;

mounting a transportation drum longitudinally in the outer pipes from an end one of the outer pipes in the excavated hole to a leading one of the outer pipes in a drilled tunnel, said mounting step including the step of fixing on an inner surface of each outer pipe in a roll mechanism including rollers on which the transportation drum is thereby rotatably mounted relative tot he pipeline;

providing an internal spiral along an internal wall of the transportation drum and along an otherwise unobstructed passage in the transportation drum so that a longitudinal free hole in the middle of the transportation drum is provided which free hole has a diameter between the spiral of at least 40% of an inner diameter of the outer pipes;

attaching a drill head to an end of the transportation drum extending beyond the leading one of the outer pipes in the tunnel for rotation with the transportation drum and with a portion of the drill head bearing longitudinally against the leading outer pipe, the drill head including a central longitudinal hole therethrough in communication with the free hole of the transportation drum;

transporting a drilling tool to the drill head through the free hole and the central hole and attaching of the drilling tool to the drill head;

rotating o the transportation drum such that the drill head and drilling tool are rotated;

drilling of a face of the tunnel by advancing of the pipeline in the tunnel as the transportation drum is rotated such that soil and rock is drilled when the drilling tool is in engagement with the face o the tunnel and the drilled soil and rock is thereby moved through the central hole to the transportation drum and then by the rotating of the spiral in the transportation drum to an end of said transportation drum in the excavated hole;

observing of the drill head and face through the free hole and the central hole to determine if replacement of the drilling tool through the free hole and central hole and transporting of a new drilling tool is required; and guiding of the drill head.

2. A method for producing an underground pipeline as claimed in claim 1 wherein a guiding means for guiding of the drill head is provided adjacent the drill head and power for the guiding means is provided by hoses, and wherein each roll device includes a frame which spans a portion of the inner surface of the outer pipe to form a passageway; and further including the step of leading the hoses from the guiding means through the passageways.

3. A method for producing an underground pipeline as claimed in claim 1 wherein the drill head includes a tool mounting bar to which the drilling tool is mountable at different radial positions; and further including the step drilling rings of different sizes in the face by mounting of the drilling tool at different radial positions on the tool mounting bar.

4. A method for producing an underground pipeline as claimed in claim 1 wherein the drilling tool includes a central tool located symmetrically about a rotating axis of the drill head and a second tool located at a distance from the rotating axis; and wherein said drilling step includes the steps of cutting a round hole with the central of the face tool in a center of the tunnel and a ring with the second tool in the face of the tunnel around the center.

5. A method for producing an underground pipeline as claimed in claim 1 wherein the drill head includes a plurality of tools, each of which is movably mounted for movement toward and away from the wall; and further including the steps of moving the tools toward and away from the face.

6. A method for producing an underground pipeline as claimed in claim 1 wherein the step of adding a successive new outer pipe to the pipeline in said assembling step includes the steps of a) securing of the new outer pipe to the immediately preceding outer pipe, b) securing a new section which is equal in length to the new outer pipe to the transportation drum, and c) locating a new roll device between the new outer pipe and the new section of the transportation drum.

7. A method for producing an underground pipeline as claimed in claim 1 wherein the drilling tool is additionally power actuated and power for the drilling tool is provided through a hose; and further including the step of locating the hose along a back side of the internal spiral in the transportation drum.

8. A method for producing an underground pipeline as claimed in claim 1 wherein the diameter of the free hole provided in the transportation drum is at least half of the outer diameter of the protective pipe.

9. A system for constructing an underground pipeline in a drilled tunnel from an excavated hole comprising:

a plurality of connected outer pipes forming said pipeline in the tunnel;

a transportation drum located in said pipeline from an end one of the outer pipes in the excavated hole to a leading one of the outer pipes in the drilled tunnel, said transportation drum being formed of a plurality of longitudinal drum sections connected together and said transportation drum having an internal wall, an internal spiral along said internal wall, and a longitudinal free hole in the middle and along the entire length thereof which has a diameter between said spiral of at least 40% of an inner diameter of the outer pipes;

a respective roll mechanism including rollers fixed to a lower part of each respective said outer pipe, said roll mechanisms supporting said transportation drum for rotating movement in and relative to said pipeline;

a drill head attached to an end of said transportation drum extending beyond said leading one of said outer pipes in the tunnel for rotation with said transportation drum and including a portion bearing longitudinally against said leading outer pipe, a drilling tool attached thereto which drills a face of the tunnel, and a central hole in communication with said free hole in said transportation drum and sized to permit said drilling tool to pass therethrough to said free hole;

a guiding means for guiding said drill head as the drilled tunnel is formed;

a motor which rotates said transportation drum and hence said drill head; and an advancing means for advancing said pipeline longitudinally along the tunnel as said drill head is rotated by said motor and drills the tunnel, said advancing means including a fluid actuator which pushes against said pipeline at one end and a side of the excavated hole at the other end to advance said pipeline and a frame in which said fluid actuator is vertically mounted in said excavated hole between said pipeline and the side of the excavated hole.

10. A system for constructing an underground pipeline as claimed in claim 9 wherein said drill head includes a tool fixture and an attaching means for attaching said drilling tool at selected radial positions relative to the tunnel along said fixture.

11. A system for constructing an underground pipeline as claimed in claim 9 wherein said drilling tool includes a central tool located symmetrically about a rotating axis of the drill head and a second tool located at a distance from the rotating axis such that rotation of said drill head causes the cutting of a round hole with said central tool in a center of the face of the tunnel and a ring with said second tool in the face of the tunnel around the center.

12. A system for constructing an underground pipeline as claimed in claim 9 wherein said drill head includes a fixture attached thereto, a cooperating fixture slide mounted to said fixture for movement in a longitudinal direction and to which said drilling tool is attached, and a moving means for selectively moving said slide and hence said drilling tool longitudinally toward and away from the face of the tunnel.

13. A system for constructing an underground pipeline as claimed in claim 12 wherein said moving means is a fluid actuator and further including a fluid hose supplying actuating fluid to said fluid actuator which is located along a back side of said spiral in said transportation drum.

* * * * *